US007025528B1

(12) United States Patent
Attar

(10) Patent No.: US 7,025,528 B1
(45) Date of Patent: Apr. 11, 2006

(54) MULTI-SIDED UNITARY BODY FOR REFLECTIVE PAVEMENT MARKER

(76) Inventor: Adil H. Attar, P.O. Box 3883, Ont, CA (US) 91761

( * ) Notice: Subject to any disclaimer, the term of this patent is extended or adjusted under 35 U.S.C. 154(b) by 0 days.

(21) Appl. No.: 10/984,263

(22) Filed: Nov. 8, 2004

(51) Int. Cl.
*E01F 11/00* (2006.01)

(52) U.S. Cl. ..... 404/16; 404/15

(58) Field of Classification Search ..... 404/14, 404/15, 16
See application file for complete search history.

(56) References Cited

U.S. PATENT DOCUMENTS 4,227,772 A * 10/1980 Heenan ..... 359/531
4,232,979 A * 11/1980 Johnson et al. ..... 404/16
4,340,319 A * 7/1982 Johnson et al. ..... 404/16
4,726,706 A * 2/1988 Attar ..... 404/14
4,875,798 A * 10/1989 May ..... 404/12
5,340,231 A * 8/1994 Steere et al. ..... 404/14
6,126,360 A * 10/2000 May et al. ..... 404/14
6,267,530 B1 * 7/2001 Attar ..... 404/16
6,334,734 B1 * 1/2002 Attar ..... 404/16
6,579,036 B1 * 6/2003 Attar ..... 404/16
6,698,972 B1 * 3/2004 Attar ..... 404/16
6,811,729 B1 * 11/2004 Attar ..... 264/1.9

* cited by examiner

*Primary Examiner*—Gary S. Hartmann

(57) ABSTRACT

Improved multi-sided reflective pavement marker is disclosed having an integrally molded hollow structural body and two retro-reflective lens means for attachments.

The lens means integrally includes retro-reflective cube corner elements within cell like areas defined by a periphery wall and multiple of partition walls.

The hollow structural body having two tilted multi-angular sides, each with low impact regions and a centralize recessed means being adopted to define a finger grip area, a planar top surface, a sealed base surface including impact absorbing hollow cavities and further including multiple of recessed grooves, said structural body further includes two inclined front and back faces, each face having a recessed area defined by a periphery wall and including multiple of load carrying partition walls toped with wedge shaped energy directors for attaching said retro-reflective lens means.

4 Claims, 6 Drawing Sheets

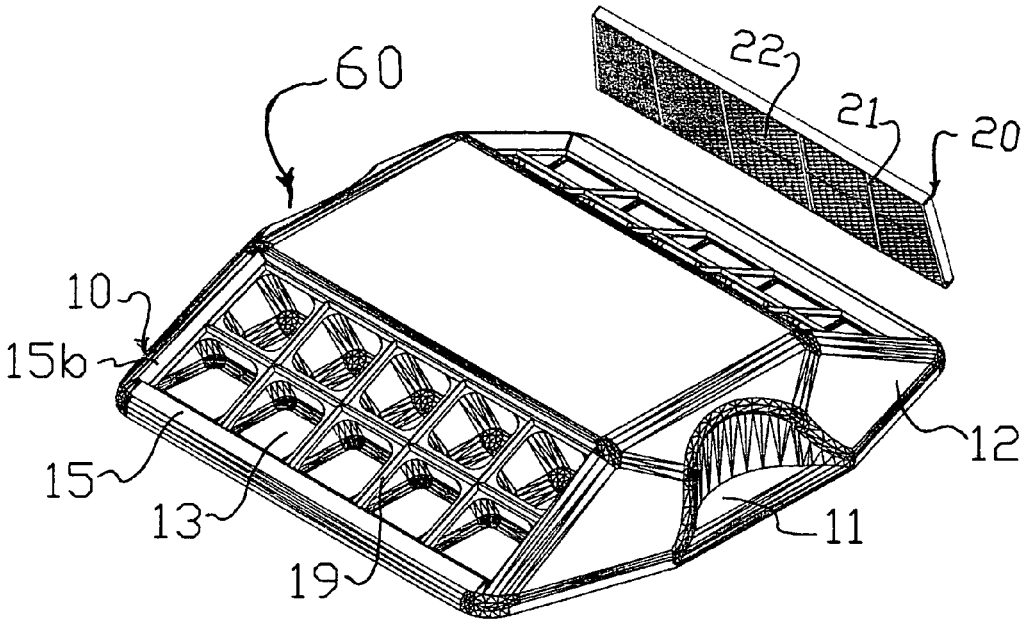
FIG. 6
FIG. 7
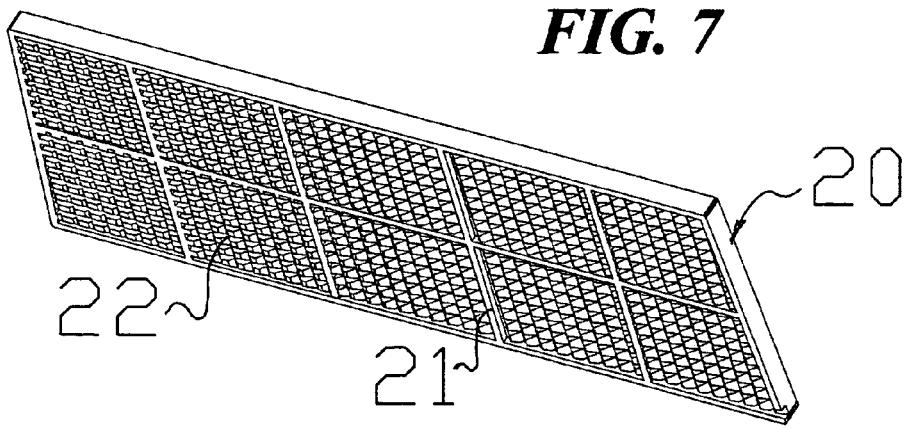

MULTI-SIDED UNITARY BODY FOR REFLECTIVE PAVEMENT MARKER

FIELD OF INVENTION

The present invention relates to improved pavement marker that are retro-reflective when used for traffic lane delineation, in particular, to such a marker with monolithically formed hollowed structural body having sealed base and top surfaces, tilted multi angular sides each with finger grip slot and inclined front and back surfaces with recesses for lens attachment.

BACKGROUND OF THE INVENTION

Roadway markers are mounted on the surface of a roadway, along centerlines, edge lines, to delineate lanes for vehicular traffic.

Examples of commonly used retro-reflective pavement markers using a shell like housing filled with structural polymeric filler material are based on Heenan U.S. Pat. No. 3,332,327, Balint U.S. Pat. No. 3,409,344, or Hedgewick U.S. Pat. No. 5,002,424.

This type of markers is produced in a process consisting of three to four steps:

Firstly, injection molding of a thermoplastic housing (shell), integrally molded with one or two reflective faces, the shell coated with a reflective metallic sealer by a process known as vacuum metalizing, the shell is then filled with a resinous filler material encapsulating the metalized cube corner reflective elements, thereby provide the marker the impact resistance structural body. This type of markers worked well for several months; however, due to abrupt intersection points within the exterior geometric configuration of these markers and the incompatibility of the material composition for forming this type of resinous filled shell markers, often causes pealing and chipping of the reflective face, thereby losing retro-reflectivity. Several method of applying abrasion resistant coating has been used to improve such pavement markers.

Other major development in the pavement marker art has been made; this was achieved by eliminating the use of the metalized sealer for the cube corner reflective elements.

This applicant U.S. Pat. No. 4,726,706, which is incorporated herein by reference in its entirety, divide the inside surfaces of the reflective faces into reflective cells, each cell having multiple cube corner reflective elements, the cells isolated from each other by partition and load carrying walls. Instead of metelizing the inside surfaces, the entire inside surfaces of the reflective faces are sealed with a thin polymeric sheet prior to filling the shell with resinous polymeric filler. The use of resinous filler material for patent '706 made it inherit similar disadvantages as '327 patent.

Other prior art pavement markers have been designed attempting to reduce oncoming tire impact, attain better daytime visibility as well as doing away with the use of resinous filler material.

U.S. Pat. No. 5,667,335 to Khieu discloses a pavement marker comprises of three distinct parts, a base part with structural walls defining hollow cavities, a fiber reinforced shell having two inclined faces with at least one face having raised energy directors within a recessed area and at least one reflective lens plate having cube corner reflective elements; that is, three parts welded together to form the reflective pavement marker of patent '335.

The assignee of '335 patent developed U.S. Pat. No. 6,126,360 to May who essentially used exactly the same exterior geometry and three piece element composition of the pavement marker of '335 patent and attempted to reduce the cost of the same pavement marker, by replacing the fiber reinforced material for forming the (shell like housing) with the same polymeric material which the lens plate and the base part are made of.

U.S. Pat. No. 6,102,612 to Pricone discloses a sun country pavement marker 105 which essentially the same three piece pavement marker of '335 patent with slight change. Marker 105 comprises a body member 110, a top member 130, and one or two reflective lens plates 192 agglutinated within designated recesses. In order to form hollowed body member 110, the top surface is open defining the hollowed body, which is sonically sealed with the additional third member 130 to complete a unitary structural body.

Several prior arts attempted to utilize a unitary structural body for reflective pavement marker fabrication. For example, U.S. Pat. No. 5,392,728 to Spear et al discloses an extruded one piece body with constant cross section having abrupt vertical sides which can be strongly felt during tire impact.

U.S. Pat. No. 4,875,798 to May et al discloses a pavement marker having one piece rigid body supported with partitions walls forming multiple hollow cavities which are open at the base surface. These open cavities at the base eliminated considerable bonding base surface parameter, thereby reduced the bond to the roadway surface.

U.S. Pat. No. 6,109,821 to Montalbano discloses a pavement marker with one piece solid body made of a closed cell foam thermoplastic. This type of material has limited durability due to the air entrapment for creating a low density solid plastic body.

The use of monolithically formed one piece hollowed structural body integrally containing multiple load carrying walls with wedge shaped top ends was disclosed by this Applicant's U.S. Pat. No. 6,267,530 and U.S. Pat. No. 6,579,036. Although the wedged shape top surfaces of the load carrying walls within the recessed area of the front and back faces of the structural body of '036 was deemed to be sufficient for directly welding the reflective lens plate.

However, there was no recognition apparent from the '530 or '036 patents that the cube corner reflective elements need to be within a defined cell like areas within the lens plate defined by partition walls. These partition walls within the lens plate are precisely located to correspond with the locations of the wedged shape energy directors at the top open ends of the load carrying partition walls and the periphery for the recessed faces of the structural body. It has been discovered that by adding a wedged shape top to the periphery walls within the recessed face area of the structural body would enhance bonding the lens plate to the recessed faces of the structural body. This is especially effective when using the standard cube corner reflective lens plate means such as those used in U.S. Pat. No. 3,332,327 to Heenan. However, when micro cube corner reflective means, similar to those used for U.S. Pat. No. 4,875,798, are used to form the reflective lens plates there would be no need to provide wedged shape top to the periphery area within the recessed faces.

Also it has been found that tire impact can be reduced on the reflective faces of present pavement marker through the use of tilted, multi angular sides with protruded intersection regions, which are lower than the pavement marker top periphery.

The present invention pavement marker with tilted, multi angular sides attain better daytime visibility by exposing a larger area of non-reflective surfaces to the oncoming vehicular traffic. A second means of reducing tire impact on the lens plates within the inclined front and back faces of the pavement marker is through the use of multiple circular or rectangular recesses that are open within the base area. The rectangular recesses act as shock absorber when vehicular tire impact the tilted angular sides, thereby minimize damages caused from direct impact on the lens plates.

The goal of this invention is to have a durable pavement marker with high reflectance, low cost and utilizing the monolithically formed one piece structural body having low impact region and internally formed recesses for shock absorption.

SUMMARY OF THE INVENTION

The principle object of the present invention is to provide a retro-reflective pavement marker that would utilize an improved unitary structural body that provide daytime visibility by exposing larger areas of non-reflective surfaces to the oncoming vehicular traffic, longer reflective life, lower impact regions and providing a lens plate attachment means having better retro-reflective face with protective raised bumpers.

This is accomplished partly by providing the monolithically formed multi-sided unitary structural body with tilted multi-angular sides that lower the vehicular tire impact regions for smoother ride and incorporating multiple shocks absorbing rectangular recesses having open ends within the bottom surface of the structural body.

Another objective of the present invention is to provide a reflective pavement marker with a one-piece multi-sided unitary structural body having two inclined reflective faces each having a recessed area including a periphery wall and the open ends of load carrying walls toped with wedge shaped energy directors to enhance bonding of the reflective lens plate means to the recessed faces of said multi-sided unitary structural body.

A preferred form of a reflective lens plate means for the present pavement marker can have a surface divided into rectangular or square cells corresponding to the size and shape of the hollow cavities within the inclined reflective front and back faces of the unitary structural body.

Each cell like area within the reflective lens plate means is integrally having multiple cube corner reflective means. The preferred reflective lens plate means has an outside surface with raised bumpers corresponding to the periphery of the interior reflective cells, thereby eliminating contact with vehicular tires.

The present invention multi-sided unitary structural body is a considerable improvement and more economical for the process of forming a thermoplastic structural body.

In order for any of the previous arts to form similar structural body, they would typically need an additional part to seal the bottom or the top surface.

Another objective of the present invention is to provide the outer surface of the reflective lens plate means with an abrasion resistant coating composition, such as an acrylate based polymer coating composition, or using a chemical vacuum deposition method for providing such hard exterior coating.

BRIEF DESCRIPTION OF THE DRAWINGS

FIG. 6 is an isometric view of yet another preferred unitary structural body showing a reflective lens plate means for attachment;

FIG. 7 is an isometric view of a preferred reflective lens plate having reflective cells defined by partition walls;

DETAIL DESCRIPTION OF PREFERRED EMBODIMENTS

The raised reflective pavement marker assembled in accordance to the present invention includes two relatively thin lens plates molded from thermoplastic such as polycarbonate resin, at least one lens plate is a transparent thin plate with one surface integrally partitioned into cells having multiple of cube corner retro-reflective means, and a monolithically formed multi-sided unitary structural body according to the subject invention.

The multi-sided unitary body 30 is injection molded from the same polycarbonate thermoplastic resin used for fabricating the reflective lens plate means except being pigmented with an opaque pigment, preferably this type of polycarbonate resin is selected from the group of resins known to the art as resilient, high impact resistant and UV stabilized resin.

Figure 1:
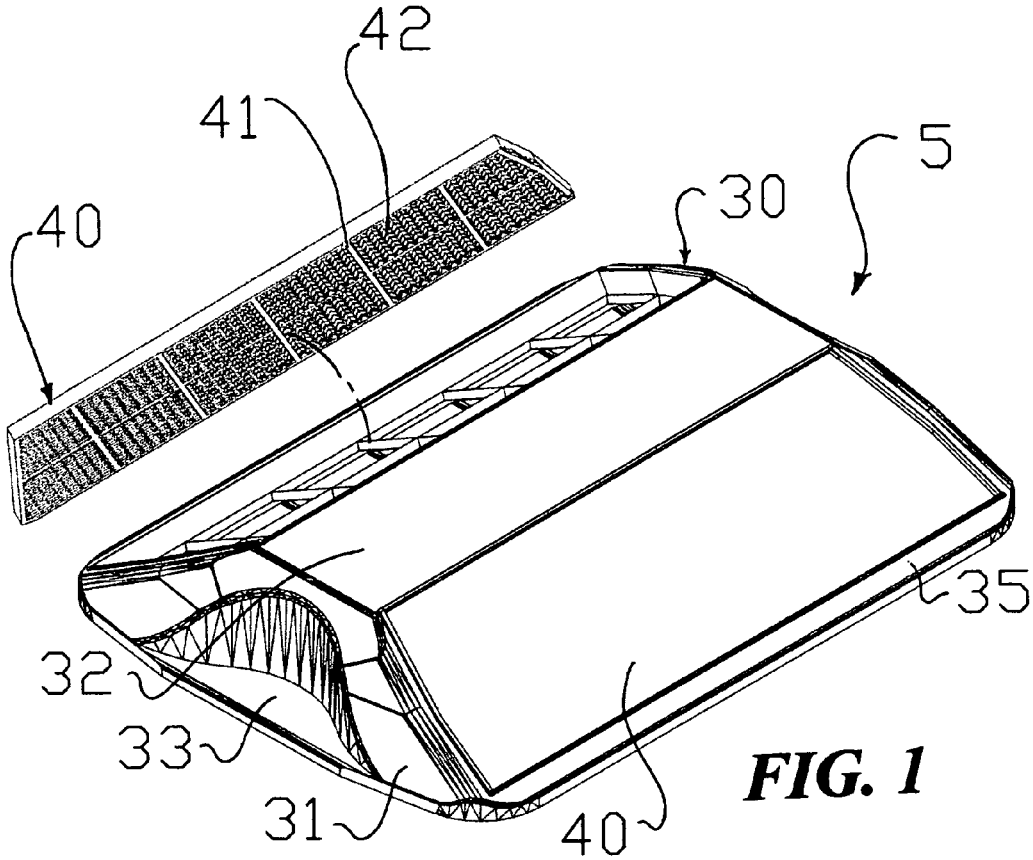
FIG. 1 is an isometric view of a preferred reflective pavement marker having multi angular sides with finger grip slots.
Figure 2:
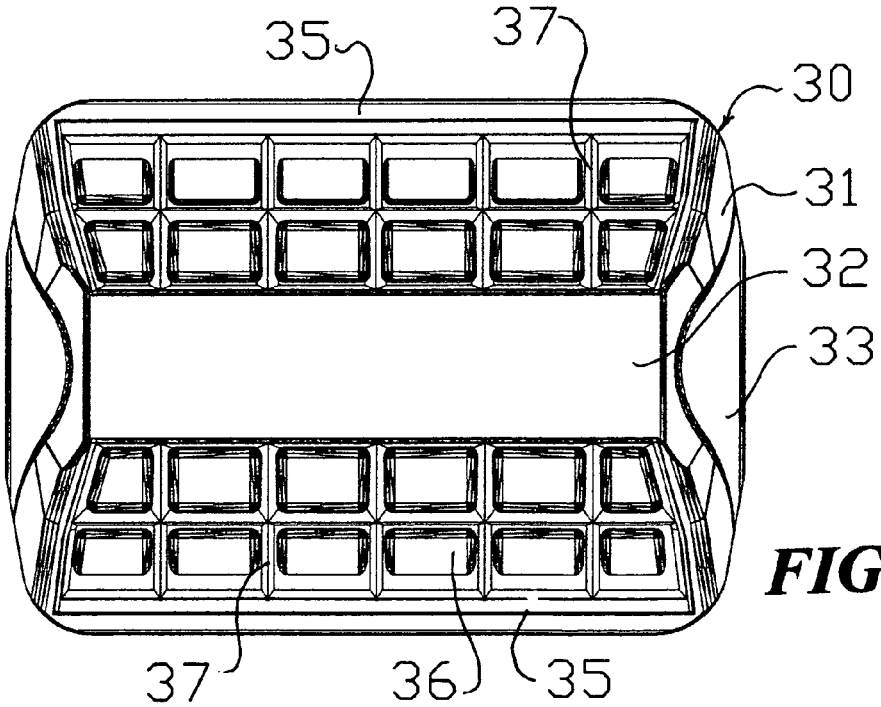
FIG. 2 is a plan view of the unitary body of pavement marker of FIG. 1.
Figure 3:
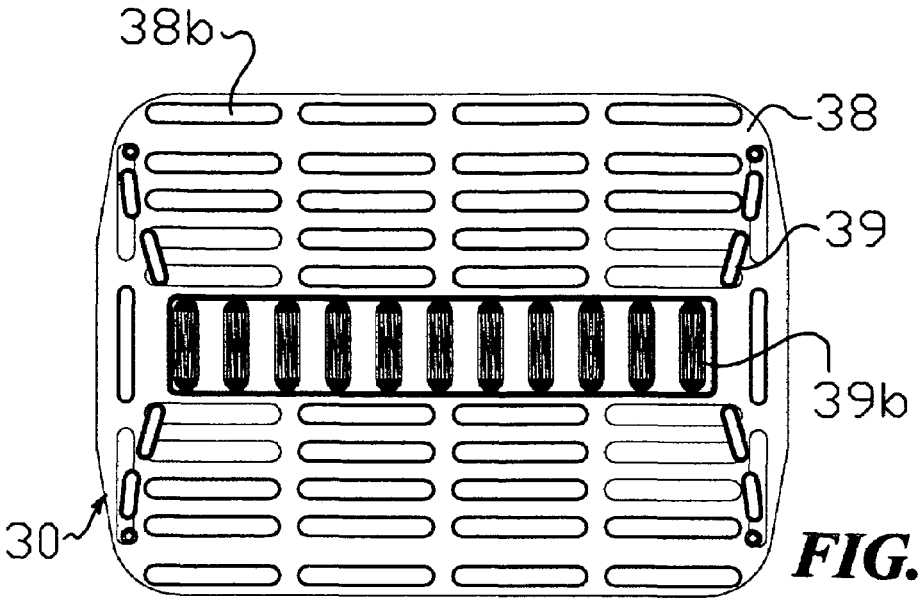
FIG. 3 is a plan view of the bottom surface for unitary body of pavement marker in FIG. 1.
Figure 4:
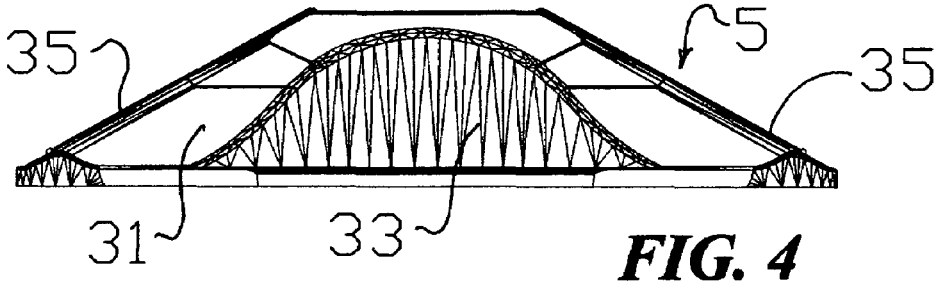
FIG. 4 is a side view of the pavement marker of FIG. 1 showing the finger grip slot.
Figure 5:
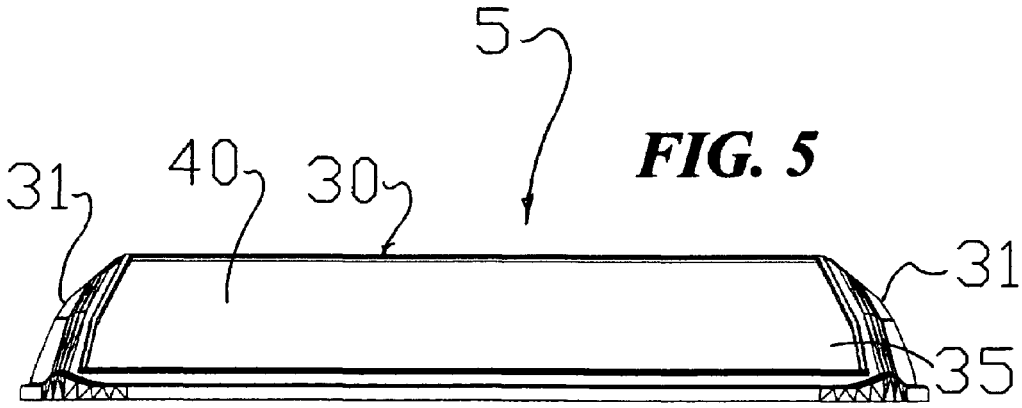
FIG. 5 is an elevation view of the pavement marker of FIG. 1 showing the sides with low impact regions and a blank lens plate attachment.
Figure 8:
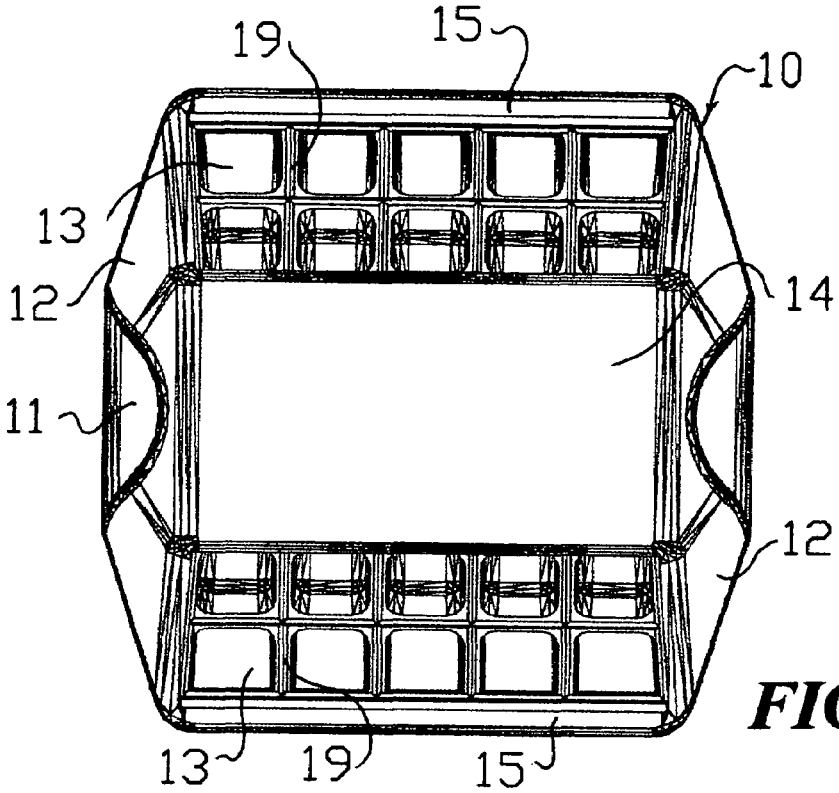
FIG. 8 is a plan view of the unitary structural body of the reflective pavement marker embodying in FIG. 6.

By the term "a" as used herein with respect to a class of components is meant "one or more". Conventional reflective pavement markers with one piece unitary structural body are discussed in U.S. Pat. Nos. 6,267,530 and 6,579,036, which are herein incorporated by reference. Referring now to the reflective pavement marker 5 of FIGS. 1–5 comprises a monolithically formed rigid structural body 30, and two lens plate means 40, at least one of the lens plate means integrally includes retro-reflective cube corner means (reflective means are not drawn to size). The monolithically formed unitary structural body 30 has two inclined front and back faces 35, a planar top surface 32, a sealed bottom surface 38, and two tilted multi angular sides 31 each of which having a finger grip slot 33. Each face 35 is having a recessed area of about 0.06 to 0.125 inch in depth, in which multiple of hollow cavities 36 are integrally formed defining a periphery region and load carrying walls 37 having wedged shape top surfaces which act as energy directors for sonic welding, as seen in FIG. 2.

Wedged shape energy directors are integrally incorporated to the periphery walls within the recessed area of face 35 within structural body 30 to enhance bonding the reflective lens plate means 40 to the recessed area of face 35.

This is especially become effective when using the standard cube corner reflective means such as those used in U.S. Pat. No. 3,332,327 to Heenan and U.S. Pat. No. 4,726,706 to Attar.

However, there would be no need to provide wedged shape energy directors on the upper flat part of the periphery region within the recessed area of face 35 when micro cube corner reflective means are used having cube corner means similar in size to those described in U.S. Pat. No. 4,875,798 to May et al and U.S. Pat. No. 3,712,706 to Stamm.

Preferably, the hollow cavities 36 each have a centerline that form an angle of about 70 to 90 degrees with respect to the bottom surface 38, and are sealed at about 0.08 to 0.10 inch above the bottom surface 38 of the unitary structural body 30.

Figure 9:
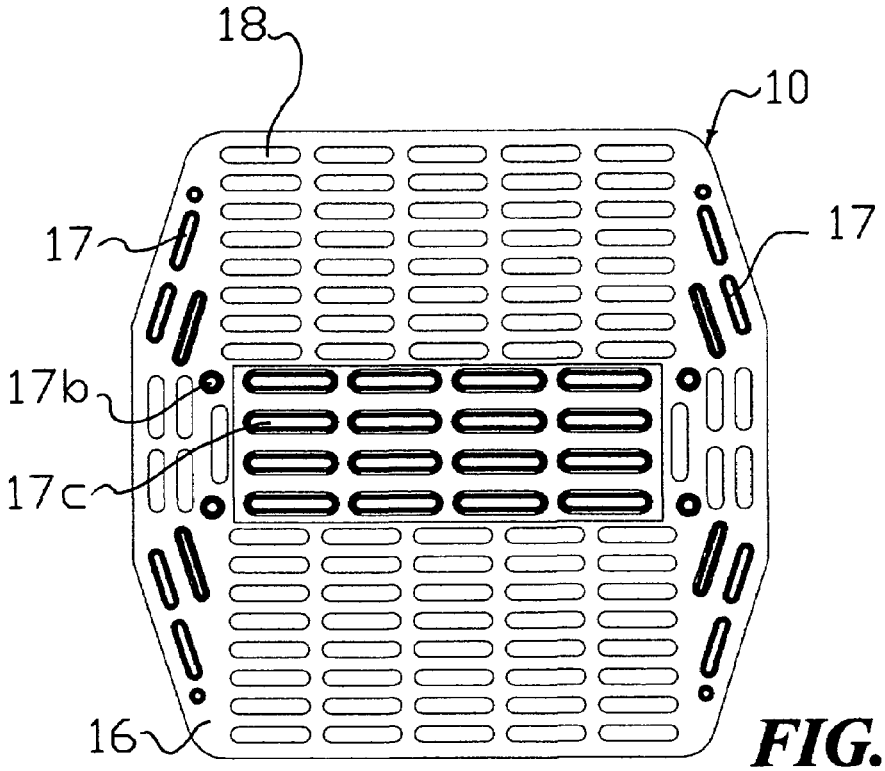
FIG. 9 is a plan view of the bottom surface for the marker unitary structural body of FIG. 6.
Figure 10:
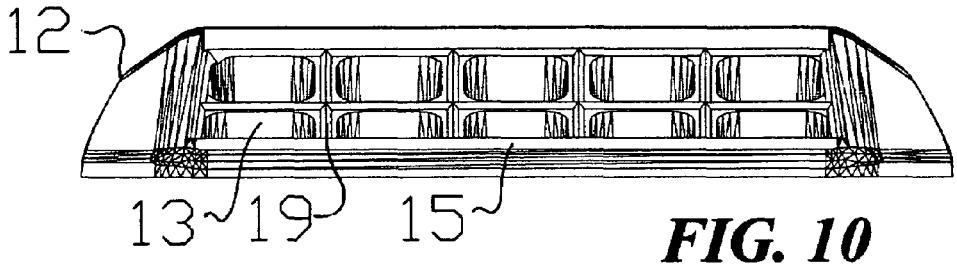
FIG. 10 is an elevation view of the unitary body of FIG. 6 showing the recessed face with wedge shaped open ends of partition walls.
Figure 11:
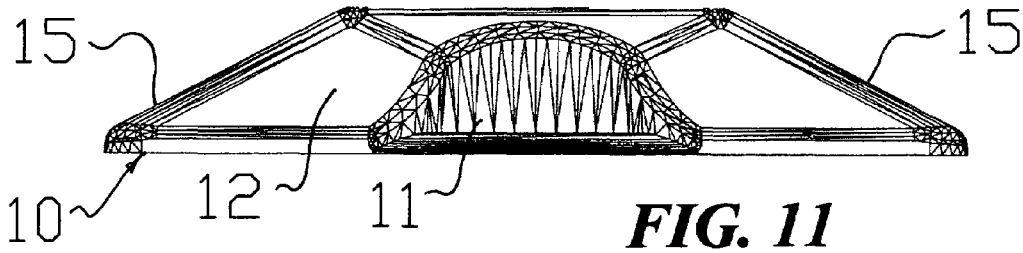
FIG. 11 is a side view of the unitary body of FIG. 6, showing a finger grip slot.

It has been found that tire impact can be considerably reduced on the reflective faces 35 of present pavement marker through the use of tilted, multi angular sides 31 with protruded intersection regions. This is achieved by vertically tilting the lower portions of sides 31 forming an angle of about 65 to 75 degrees with respect to the bottom surface 38, thence tilting the remaining height about 50 to 55 degrees. The front and back lower portions of sides 31 were also tilted horizontally creating the multi-sided shape of bottom surfaces 38 and 16 respectively(shown in FIG. 3 and FIG. 9), thereby providing better daytime visibility by exposing larger areas of sides 31 non-reflective surfaces to the oncoming vehicular traffic.

Each side 31 integrally has a finger grip means 33 for providing easier handling and insulation process. The sealed bottom surface 38 is provided with multiple of groove means 38*b* having about 0.01 to 0.03 inches in depth for increasing the adhesion wetting parameter.

Whereas, recess means 39 having about 0.15 to 0.50 inches in depth are provided for reducing tire impact on the sonically welded lens plate means 40 within the inclined front and back faces 35. Preferably, recess means 39 have circular or rectangular shapes, and are open within the bottom surface area 38.

The deeper recess means 39 act as shocks absorber when vehicular tire impact the tilted angular sides, thereby minimize damages caused by direct tire impact on lens plates 40. A preferred form of a reflective lens plate means 40 for pavement marker 5 can have an overall thickness of about 0.06 to 0.125 corresponding to the recessed areas within inclined faces 35, and having an interior surface divided into rectangular or square cells 42 corresponding to the size and shape of the hollow cavities 36 within the front and back faces 35 of the unitary structural body 30. Each cell like area 42 within the reflective lens plate means 40 is integrally having multiple cube corner reflective means (no size or types selected herein) defined by partition walls 41. The preferred reflective lens plate means 40 has an outside surface with raised bumpers of about 0.01 to 0.02 inch high, which are positioned as extensions to the partition walls 41 defining the interior reflective cells 42.

Typically the reflective lens plate means 40 are injection molded, especially when incorporating the standard reflective cube corner elements used in '327 patent.

When desired to use thinner lens plate means 40 with an overall lens plate thickness of about 0.07 to 0.09 inch, a specially made master mold of about 10 inch by 10 inch can be made based on the teaching of U.S. Pat. No. 3,712,706 to Stamm, and using only two vertically intersecting grooves to develop a stamping mold for mass production of reflective lens plate 40. A prefabricated sheet of transparent and UV stabilized polycarbonate is used to emboss the three dimensional micro reflective cube corner means, and then the 10 by 10 inch sheet is cut to size forming multiple reflective lens plate 40.

To provide an abrasion resistant exterior surface for the reflective lens plate means 40, an abrasion resistant coating composition, such as a dispersion of silica colloid with multifunctional acrylate polymer coating formulations can be attained.

Several abrasion resistant resin coating compositions are readily available and applicable for use in the present invention, and are discussed in U.S. Pat. Nos. 4,355,135, 5,126,394 and 5,648,173, assigned to Dow Corning Corporation, U.S. Pat. No. 4,486,504 to Chung et al, and U.S. Pat. No. 4,702,773 to Lysander, which are herein incorporated by reference. Alternatively, several chemical vacuum deposition methods are applicable and can be used, however, these methods need slightly higher initial capital investments for equipments and tooling.

FIGS. 6–12 illustrate yet another embodiment of a multi-sided reflective pavement marker 60 based on the present invention.

This reflective pavement marker embodiment 60 is similar to the marker 5 of FIGS. 1–5, for being assembled from two elements, a monolithically injection molded one piece unitary structural body 10 and two lens plates 20 (only one schematic lens plate is shown in FIG. 6), at least one of which integrally includes retro reflective means (no actual size or type of reflective means are shown in FIG. 6 or 7).

The unitary structural body 10 has a planar top surface 14 with relatively larger depth of about 1.2 to 1.8 inch, a front and back faces 15 each having a recessed area that house multiple hollow cavities 13, a textured bottom surface 16 including grooves 18 and the shocks absorbing recess means 17, and two multi angular sides 12 with considerably sharper horizontal tilt for providing maximum non-reflective daytime visibility by exposing even larger opaque surfaces of sides 12 to the oncoming vehicular traffic. Sides 12 also include integrally formed finger grip means 11 for providing easy insulation and handling process.

It has been found that in order to reduce material waste in fabricating the multi-sided unitary structural body 10 having relatively wider top surface 14, the hollow cavities 13 would preferably need to be positioned forming acute angles with respect to the bottom surface 16 and provide multiple recesses 17*b* and 17*c* of about 0.40 to 0.55 inches in depth beneath the planar top surface 14.

Typically a commonly preferred dimension for the structural body 10 is being about 4.0 inch wide and about 3.0 to 4.0 inches in depth.

Figure 12:
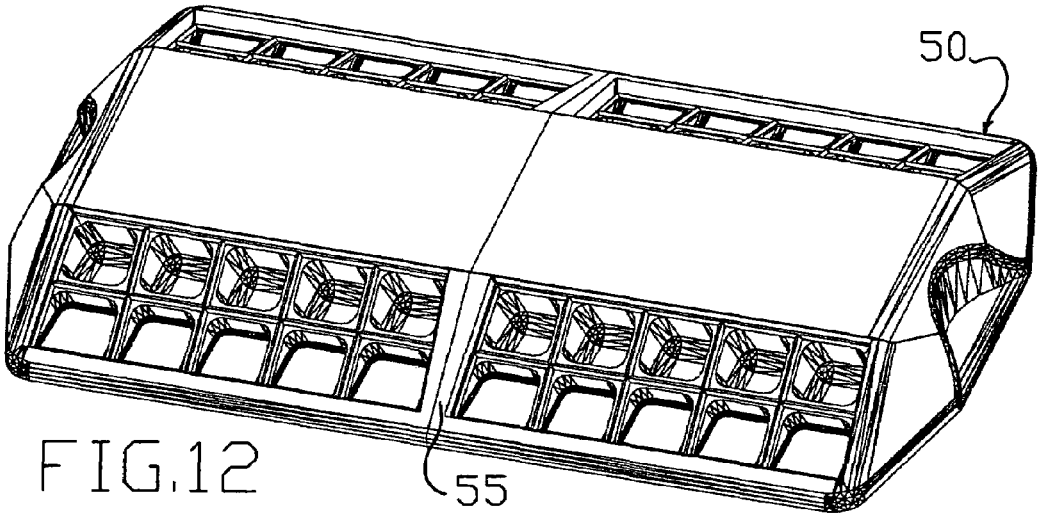
FIG. 12 is an isometric view of a preferred unitary double width structural body.

FIG. 12 shows a novel multi-sided double structural body 50 having about 7.0 to 10.0 inches in width and a depth of about 3.0 to 4.0 inches. Structural body 50 incorporated two reflective lens plate means 20 on each inclined face 55, thereby forming a double width reflective marker.

This type of double width reflective pavement marker ideally can be used within the double stripping regions or the Y-intersection of roadways.

It will be understood that the particular embodiments of the invention are shown by way of illustration and not as limitation of the invention. The principal features of this invention can be employed in various embodiments without departing from the scope and the spirit of the invention. This invention is not limited to the exact apparatuses illustrated and described; alternative apparatus can be used to form the intended monolithically formed reflective pavement marker body as well as the reflective lens plate means of this invention. Changes or modifications can be made within the scope of the appended claims to the above-preferred method of forming one-piece reflective marker. Therefore; the invention can be practiced otherwise than as specifically described herein.

What is claimed is:

1. A multi sided reflective pavement marker comprising:

a) a lens means for providing retro reflectivity for vehicular traffic, said lens means having planar outside surface with multiple raised protective bumpers of about 0.01 to 0.02 inch in height, said lens means having inside surface with multiple of cells defined by slightly raised partition walls, said cells each integrally having multiple of cube corner retro reflective elements, said outside protective bumpers are correspondently aligned to said interior partition walls of said lens means;

b) a one-piece monolithically molded hollow structural body for providing structural support for said lens means, said structural body integrally having two inwardly tilted multi angular sides, each of said sides having a centralize recessed means being adopted to define a finger grip area, a top planar surface, a sealed planar base surface including impact absorbing hollow cavities and further including multiple of recessed grooves, wherein said structural body further includes two inclined planar faces, each of said inclined planar faces having a planar recessed portion integrally including a periphery wall and multiple of partition and load carrying walls with raised wedge shaped energy directors defining multiple hollow cavities, said wedge shaped energy directors for attaching said retro-reflective lens means.

2. The reflective roadway marker as defined in claim 1, wherein said multiple of hollow cavities within said recessed portions of said front and back inclined faces are integrally being defined by said load carrying partition walls, said hollow cavities each further is defined by a centerline, each of said centerline forming an angle of about 70° to 90° with respect to said planar base surface of said structural body, said hollow cavities each having a depth that terminate about 0.08 to 0.10 inch above said outside planar base surface.

3. The reflective roadway marker as defined in claim 1, wherein said sealed, planar base surface is having a textured and recessed grooves, said grooves each having a depth of about 0.02 to 0.05 inch.

4. The reflective roadway marker as defined in claim 1, wherein said outside surface of the lens means is coated with abrasion resistance hard resinous coating composition to improve abrasion resistance and enhance durability.

* * * * *